US005491985A

United States Patent [19]

Quattlebaum

[11] Patent Number: 5,491,985

[45] Date of Patent: Feb. 20, 1996

[54] EARRING HOLDING DEVICE

[76] Inventor: Alfred M. Quattlebaum, 226 SE. Fry Ter., Port Charlotte, Fla. 33952

[21] Appl. No.: 359,554

[22] Filed: Dec. 20, 1994

[51] Int. Cl.[6] ..... A44C 7/00

[52] U.S. Cl. ..... 63/12; 63/2

[58] Field of Search ..... 63/2, 12

[56] References Cited

U.S. PATENT DOCUMENTS

| | | | |
|---|---|---|---|
| 5,154,068 | 10/1992 | Di Domenico | 63/12 |
| 5,375,433 | 12/1994 | Skalet | 63/12 |
| 5,400,620 | 3/1995 | Cervo et al. | 63/12 |

FOREIGN PATENT DOCUMENTS

| | | | |
|---|---|---|---|
| 276197 | 7/1988 | European Pat. Off. | 63/12 |
| 551120 | 7/1993 | European Pat. Off. | 63/12 |
| 2249019 | 4/1992 | United Kingdom | 63/12 |
| 2021262 | 12/1992 | WIPO | 63/12 |

*Primary Examiner*—Michael J. Milano

[57] ABSTRACT

A new and improved earring holding device comprised of a hollow tube having an open first end and an open second end. The open first end has a flange secured around an outer periphery thereof. The hollow tube is adapted to be received within a pierced ear with the flange extending outwardly of the pierced ear.

1 Claim, 4 Drawing Sheets

EARRING HOLDING DEVICE

BACKGROUND OF THE INVENTION

1. Field of the Invention

The present invention relates to an earring holding device and more particularly pertains to enabling an earring to be easily inserted or removed from a user's ear with an earring holding device.

2. Description of the Prior Art

The use of earring mounts is known in the prior art. More specifically, earring mounts heretofore devised and utilized for the purpose of locking an earring within an ear are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,289,700 to Cheng discloses a slidably adjustable earring post.

U.S. Pat. No. 5,201,197 to Bakker discloses a pierced earring mount locking member.

U.S. Pat. No. 4,741,179 to McConnell, Jr. discloses a multi-post earring structure for pierced ears.

U.S. Pat. No. 4,593,540 to Cuvar et al. discloses a pierced earring with slidable plastic post and backing.

U.S. Pat. No. 4,543,804 to Cappiello discloses a pierced earring locking and holding system.

While these devices fulfill their respective, particular objective and requirements, the aforementioned patents do not describe an earring holding device for enabling an earring to be easily inserted or removed from a user's ear.

In this respect, the earring holding device according to the present invention substantially departs from the conventional concepts and designs of the prior art, and in doing so provides an apparatus primarily developed for the purpose of enabling an earring to be easily inserted or removed from a user's ear.

Therefore, it can be appreciated that there exists a continuing need for new and improved earring holding device which can be used for enabling an earring to be easily inserted or removed from a user's ear. In this regard, the present invention substantially fulfills this need.

SUMMARY OF THE INVENTION

In the view of the foregoing disadvantages inherent in the known types of earring mounts now present in the prior art, the present invention provides an improved earring holding device. As such, the general purpose of the present invention, which will be described subsequently in greater detail, is to provide a new and improved earring holding device and method which has all the advantages of the prior art and none of the disadvantages.

To attain this, the present invention essentially comprises a hollow tube having an open first end and an open second end. The open first end has a flange secured around an outer periphery thereof. The hollow tube is adapted to be received within a pierced ear with the flange extending outwardly of the pierced ear. The device contains an earring having a stem portion extending outwardly therefrom. The stem portion is adapted to be received within the open first end of the hollow tube. The device contains a securement device having an aperture formed therethrough. The aperture receives the stem portion of the earring therein to secure the earring within the hollow tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved earring holding device which has all the advantages of the prior art earring mounts and none of the disadvantages.

It is another object of the present invention to provide a new and improved earring holding device which may be easily and efficiently manufactured and marketed.

It is a further object of the present invention to provide a new and improved earring holding device which is of durable and reliable construction.

An even further object of the present invention is to provide a new and improved earring holding device which is susceptible of a low cost of manufacture with regard to both materials and labor, and which accordingly is then susceptible of low prices of sale to the consuming public, thereby making such an earring holding device economically available to the buying public.

Still yet another object of the present invention is to provide a new and improved earring holding device which provides in the apparatuses and methods of the prior art some of the advantages thereof, while simultaneously overcoming some of the disadvantages normally associated therewith.

Even still another object of the present invention is to provide a new and improved earring holding device for enabling an earring to be easily inserted or removed from a user's ear.

Lastly, it is an object of the present invention to provide a new and improved earring holding device comprised of a hollow tube having an open first end and an open second end. The open first end has a flange secured around an outer periphery thereof. The hollow tube is adapted to be received within a pierced ear with the flange extending outwardly of the pierced ear.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
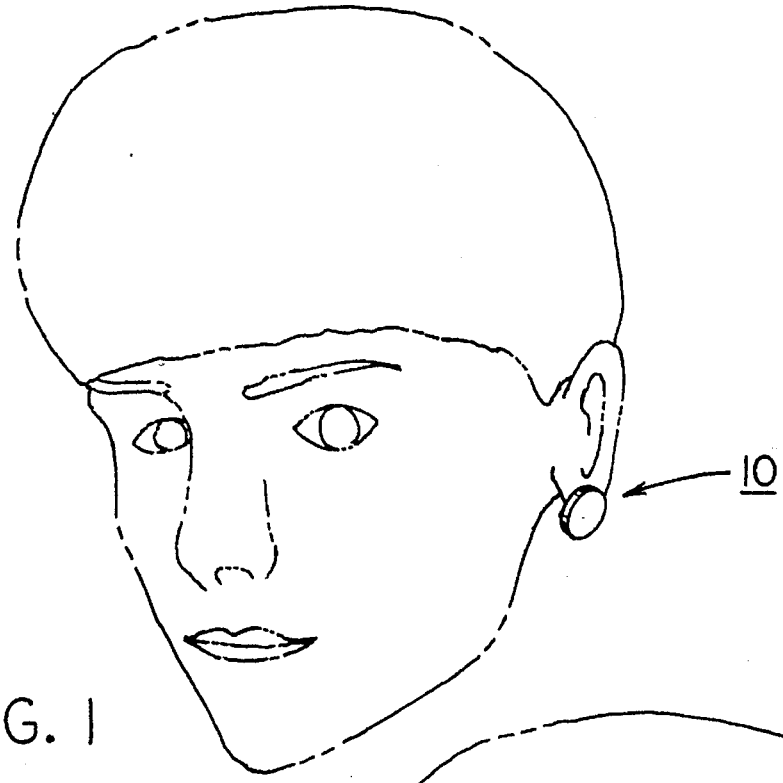
FIG. 1 is a perspective view of the preferred embodiment of the earring holding device constructed in accordance with the principles of the present invention.
Figure 2:
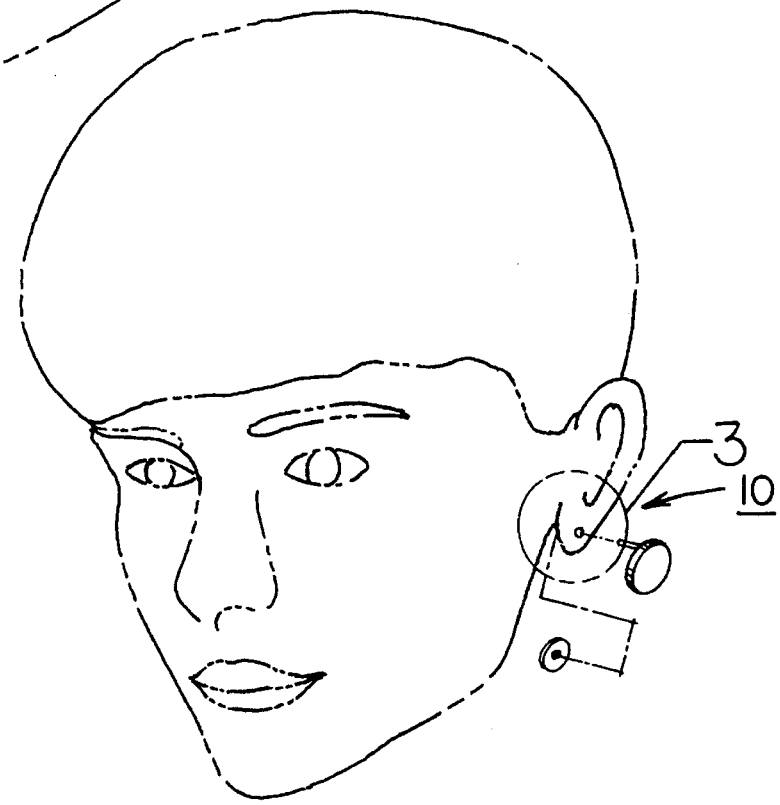
FIG. 2 is an exploded perspective view of the preferred embodiment of the present invention.
Figure 3:
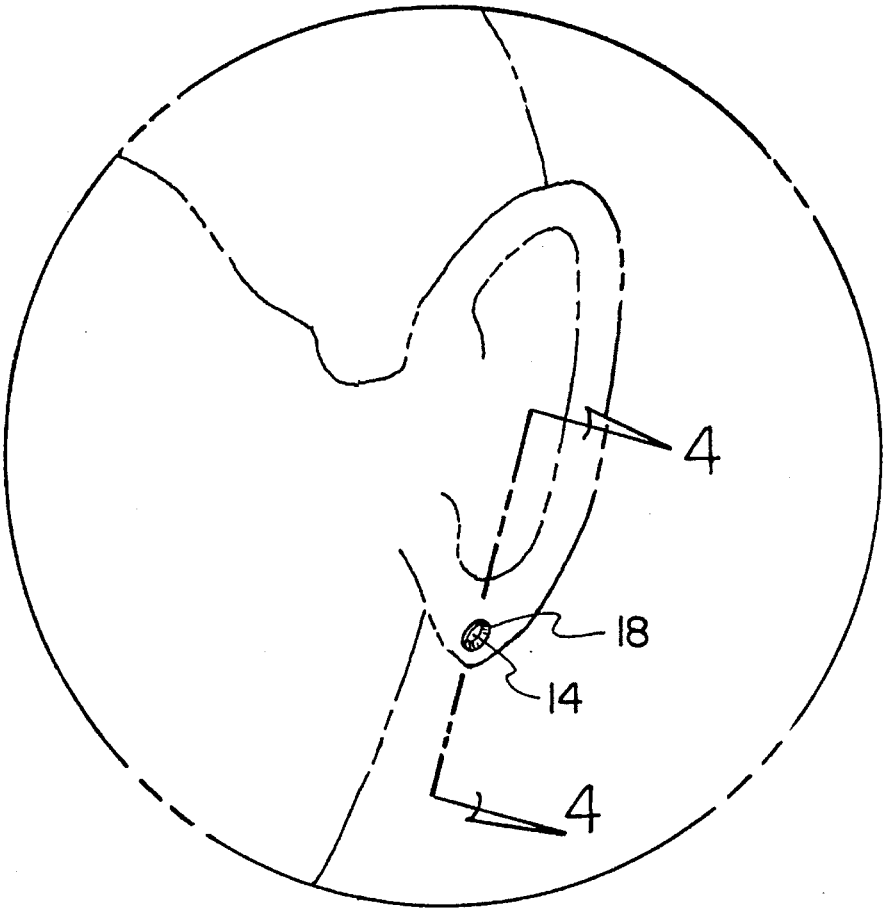
FIG. 3 is an enlarged view of the hollow tube in place in a user's pierced ear.
Figure 4:
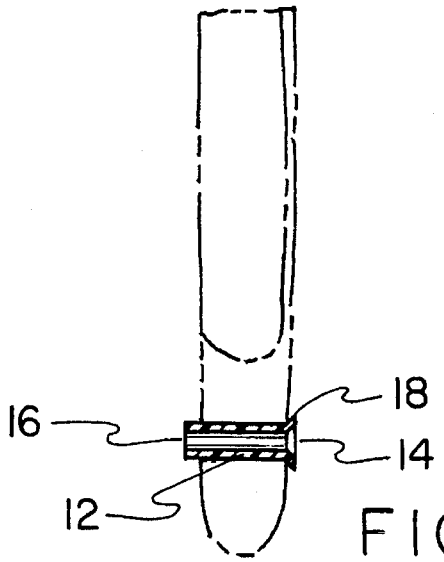
FIG. 4 is a cross-sectional view as taken along line 4—4 of FIG. 3.
Figure 5:
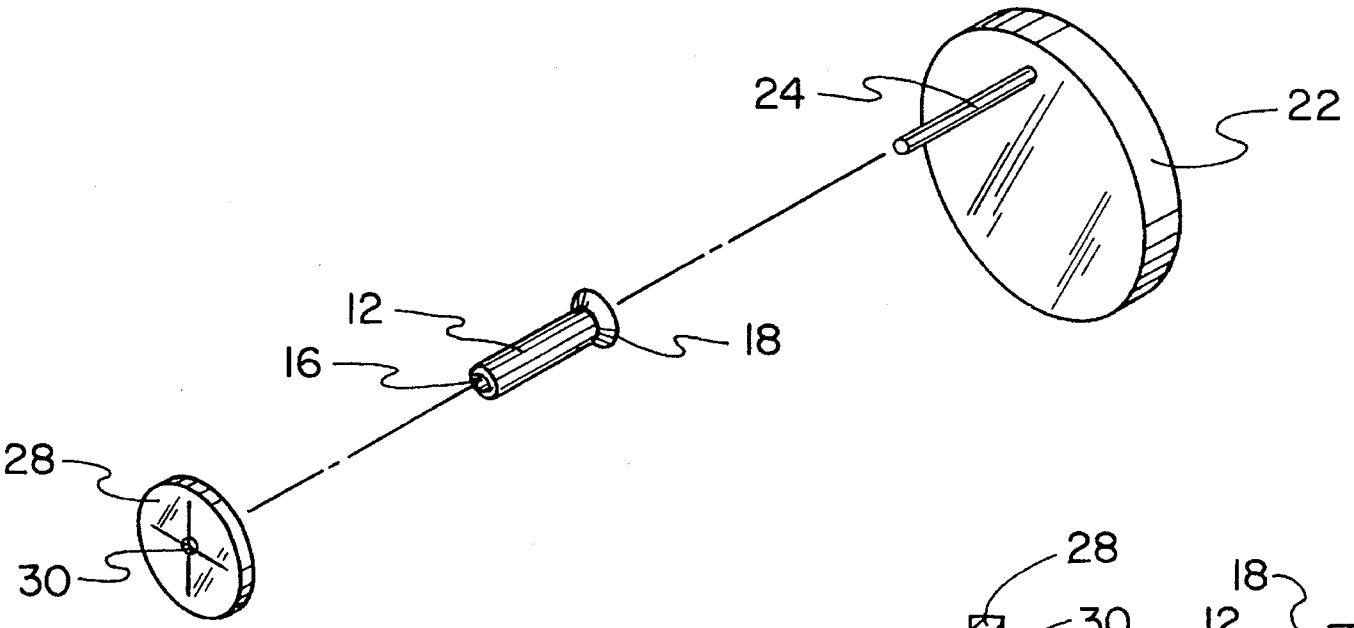
FIG. 5 is an exploded perspective view of the preferred embodiment.
Figure 6:
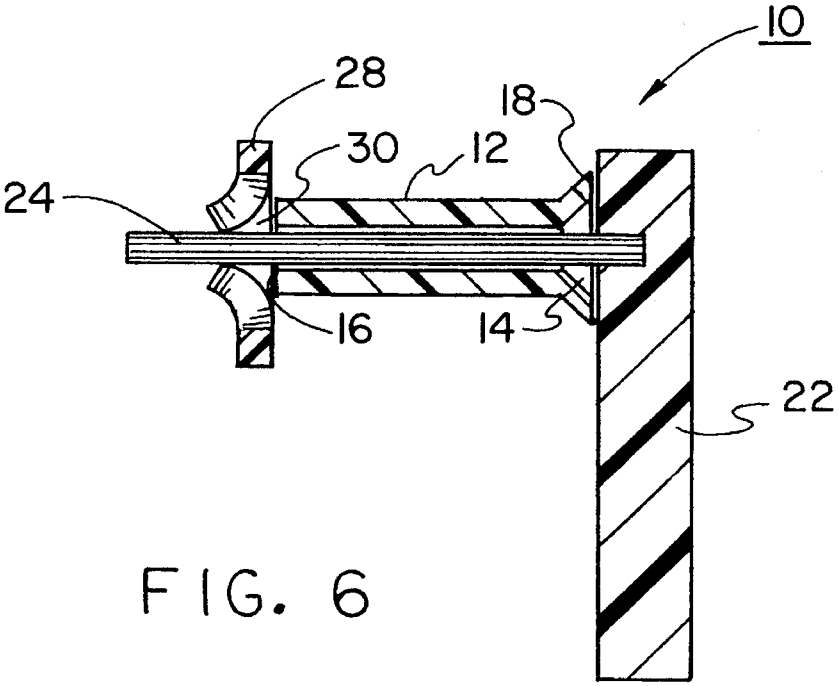
FIG. 6 is a cross-sectional view of the preferred embodiment.

With reference now to the drawings, and in particular, to FIG. 1 thereof, the preferred embodiment of the new and improved earring holding device embodying the principles and concepts of the present invention and generally designated by the reference number 10 will be described.

Specifically, it will be noted in the various Figures that the device relates to a new and improved earring holding device for enabling an earring to be easily inserted or removed from a user's ear. In its broadest context, the device consists of a hollow tube, an earring, and a securement device.

The device 10 contains a hollow tube 12 having an open first end 14 and an open second end 16. The open first end 14 has a flange 18 secured around an outer periphery thereof. The hollow tube 12 is adapted to be received within a pierced ear with the flange 18 extending outwardly of the pierced ear.

The device 10 contains an earring 22 having a stem portion 24 extending outwardly therefrom. The stem portion 24 is adapted to be received within the open first end 14 of the hollow tube 12.

The device 10 contains a securement device 28 having an aperture 30 formed therethrough. The aperture 30 receives the stem portion 24 of the earring 22 therein to secure the earring 22 within the hollow tube 12. The securement device 28 is not a necessary component of the device 10 because brackets that accompany earrings could be used in its place.

Figure 7:
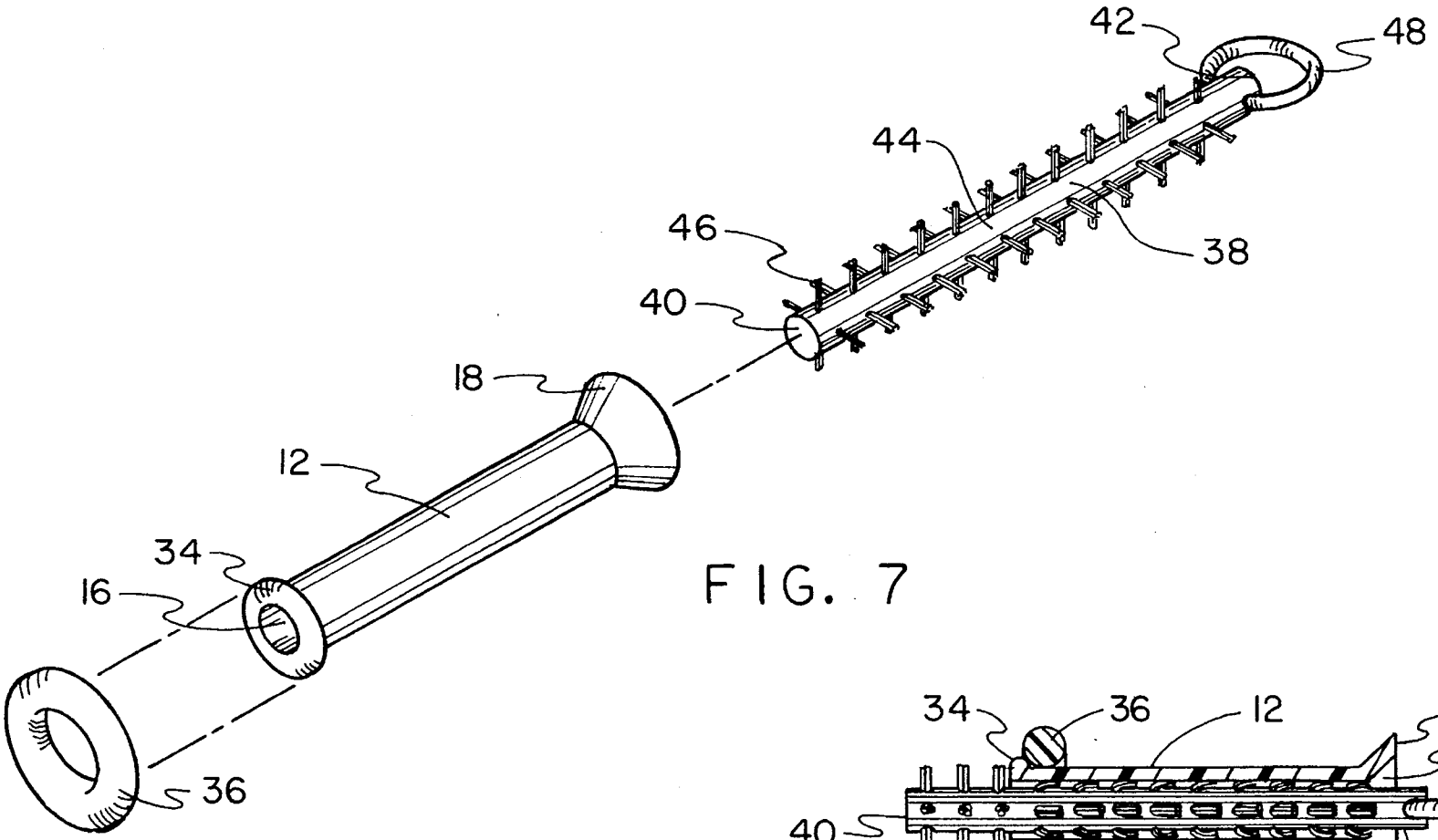
FIG. 7 is an exploded perspective view of a second embodiment of the present invention.
Figure 8:
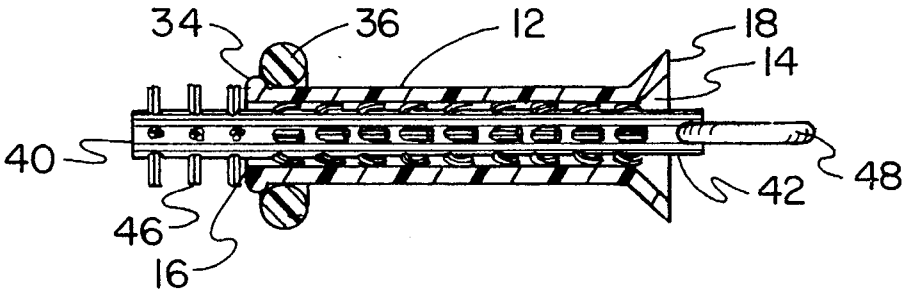
FIG. 8 is a cross-sectional view of the second embodiment.

A second embodiment of the present invention is shown in FIG. 7 and includes substantially all of the components of the present invention further including wherein the open second end 16 of the hollow tube 12 has a ring 34 secured around the outer periphery thereof. A securement ring 36 is adapted to secure around the ring 34 of the open second end 16 of the hollow tube 12. The securement ring 36 secures the hollow tube 12 within the pierced ear. Also included is a securement pin 38 having a first end 40, a second end 42, and an intermediate extent 44 therebetween. The intermediate extent 44 has a plurality of resilient bristles 46 extending outwardly therefrom. The first end 40 is adapted to be received within the open first end 14 of the hollow tube 12. The second end 42 has a securement hoop 48 theresecured. The securement hoop 48 serves to secure an earring thereto.

The present invention is a small tubular piece which is inserted into the pierced ear lobe, enabling the earring to be easily inserted and removed.

This small plastic hypo-allergenic device 10 consists of a hollow tube 12 with a flanged front end which aids in proper alignment and insertion of the earring. A coordinating washer-like device is also included which is attached to the stem 24 of the earring 22, holding it in place within the tube 12. This simple device 10 could be produced in a variety of sizes and manufactured in various flesh tones, ranging from white to black.

This tiny item can be inserted at the time of the ear piercing or afterwards. It is placed within the pierced hole of the lobe so that the flanged end is in the front. The desired earring is then inserted through the device 10 and the washer placed onto the stem 24 of the earring 22 as it exits through the rear of the ear lobe. Once this piece is secured in place, the earring remains in position until removed. Since this device 10 keeps the pierced hole in an open position, the stem 24 of the earring 22 does not come in contact with the skin, eliminating the guesswork during the insertion of the earring. To remove and replace the earring 22, the back washer is pulled from the stem 24 and the earring 22 removed from the front of the ear.

This safe and convenient device 10 is ideal for individuals who are allergic to various types of metals, eliminating infections in the pierced hole.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved earring holding device for enabling an earring to be easily inserted or removed from a user's ear comprising, in combination:

a hollow tube having an open first end and an open second end, the open first end having a_flange secured around an outer periphery thereof, the hollow tube adapted to be received within a pierced ear with the flange extending outwardly of the pierced ear;

an earring having a stem portion extending outwardly therefrom, the stem portion adapted to be received within the open first end of the hollow tube;

a securement device having an aperture formed therethrough, the aperture receiving the stem portion of the earring therein to secure the earring within the hollow tube;

a securement pin having a first end, a second end, and an intermediate extent therebetween, the intermediate extent having a plurality of resilient bristles extending outwardly therefrom, the first end adapted to be received within the open first end of the hollow tube, the second end having a securement hoop theresecured, the securement hoop serving to secure an earring thereto.

* * * * *